US005797598A

United States Patent [19]

Marschke et al.

[11] Patent Number: 5,797,598

[45] Date of Patent: Aug. 25, 1998

[54] METHOD FOR SHINGLING AND STACKING CONVEYED SHEET MATERIAL

[75] Inventors: Carl R. Marschke; Dennis W. Rodewald, both of Phillips, Wis.

[73] Assignee: Marquip, Inc., Phillips, Wis.

[21] Appl. No.: 780,933

[22] Filed: Oct. 16, 1996

Related U.S. Application Data

[60] Provisional application No. 60/005,491 Oct. 16, 1995.

[51] Int. Cl.[6] ..... B65H 29/66; B65H 29/68; B65H 29/32

[52] U.S. Cl. ..... 271/202; 271/183; 271/197; 271/270

[58] Field of Search ..... 271/182, 183, 271/202, 270, 67

[56] References Cited

U.S. PATENT DOCUMENTS

| | | | |
|---|---|---|---|
| 3,315,956 | 4/1967 | Lyman | 271/202 |
| 4,200,276 | 4/1980 | Marschke | 271/279 |
| 4,436,302 | 3/1984 | Frye et al. | 271/202 |
| 4,598,901 | 7/1986 | Thomas | 271/202 |
| 4,776,577 | 10/1988 | Marschke et al. | 271/183 |

*Primary Examiner*—William E. Terrell
*Assistant Examiner*—Patrick Mackey
*Attorney, Agent, or Firm*—Andrus, Sceales, Starke & Sawall

[57] ABSTRACT

A conveyor system wherein individual sheets are conveyed from a cutter at a given speed, are increased in speed before passing through a vacuum conveyor shingling section, are slowed down at the shingling section, and then normally proceed at a slowed down speed to the stacker which is adapted to stack a fixed number of sheets before discharging a stack. The sheets are basically handled in accordance with the device disclosed in U.S. Pat. No. 4,200,276. The vacuum shingler of the invention includes a slow-down device, such as a smoothing wheel or spring fingers, positioned above the vacuum conveyor section to nip the leading edge of the individual sheets before they contact the vacuum conveyor. The slow-down device acts to reduce the tendency of lightweight paperboard sheets to fold transversely or buckle across their width. The vacuum shingler further includes a controller which operates the vacuum conveyor section at the required speed to maintain the proper degree of shingling based on the sensed individual sheet length. Additionally, the vacuum shingler applies a source of vacuum only to the tail section of the individual sheet to further aid in proper shingling while reducing the tendency of the lightweight paperboard to buckle transversely.

14 Claims, 1 Drawing Sheet

METHOD FOR SHINGLING AND STACKING CONVEYED SHEET MATERIAL

CROSS-REFERENCE TO RELATED APPLICATIONS

This application is based on and claims priority from Provisional Application Ser. No. 60/005,491, filed Oct. 16, 1995.

BACKGROUND OF THE INVENTION

This invention relates to the shingling and stacking of conveyed sheet material, such as corrugated paperboard and the like.

In the manufacture of paperboard products, such as boxes, the paperboard is typically manufactured in a continuous running web, cut into separate sheets, stacked and then suitably further processed into the desired product. The entire operation is necessarily accomplished at high speed because of the large volume of products to be made. The conveying devices between the different stations must operate swiftly and accurately.

The practice of shingling conveyed sheet material is taught in a series of U.S. patents, as follows: U.S. Pat. No. 4,200,276 accomplishes shingling based on varying the relative speeds of the various belts in the outfeed section of a conveyor system, allowing for the creation of gaps in the outfeed stream of cut sheets to permit discharge cycles and the like. The different speeds are preset, fixed percentages of the basic line speed. Thus, the degree of shingling (the overlap between adjacent sheets) varies based on the length of a sheet. U.S. Pat. No. 4,598,901 provides for two-stage shingling, with a preshingling vacuum conveyor operating at a speed intermediate between the line speed and the shingling speed. U.S. Pat. No. 4,776,557 discloses an improvement in which the vacuum of the vacuum conveyor is modulated to provide reduced negative pressure to the forward portion of a sheet.

Heretofore and in machines such as those disclosed in the aforementioned patents which feeds sheets generally horizontally in succession through an in-feed nip and hence downstream through a vacuum shingling section, the vacuum shingler has been disposed with its upstream end at a level below the nip discharge, thus providing a drop for the traveling sheets between the infeed nip output and the vacuum shingler input. The shingler has previously been inclined upwardly in a downstream direction to facilitate proper shingling of the sheets as they skimmed across the shingler and were ultimately slowed by the continuously applied vacuum.

The operation of such known shinglers has been generally satisfactory at moderate sheet speeds, such as 500–650 ft./min. However, faster sheet speeds, such as 1,000 ft./min. have become increasingly desirable. One problem occurring with faster speeds, that of scattering of the shingles, has been addressed and basically solved by the dual-shingler system of the aforesaid U.S. Pat. No. 4,598,901. However, another problem has been observed as sheet speeds have increased.

As the sheets have traversed the vacuum shingler, they have had a tendency to fold transversely or buckle across their width. This so-called "beam breaking" has not only damaged the sheets, but has also caused jam-ups in the machine at the vacuum conveyor section, sometimes resulting in undesirable downtime to clear the jam.

The cause of the buckling problems is believed to have been identified by the present inventors. It is believed that the sheets, particularly lightweight paperboard, entering the vacuum shingler are not as strong or rigid as the shingler was designed to handle. When the paperboard is formed in the upstream processing device, it is in a damp or wet state. Previously, and at slow operational speeds, the web fed continuously from the upstream processing device has had time to substantially fully dry before being cut into sheets and shingled. The shingler can handle the dry sheets which have low moisture content and structural integrity. However, with increased machine speeds, the paperboard does not fully reach the dry state before entering the shingler and may even be soggy at that point. Thus, as it drops downwardly from the infeed nip output onto the inclined vacuum conveyor, it tends to "beam break" or crease transversely. Furthermore, as the forward portion of the damp sheet is pulled down by the vacuum of the shingler, the sheet is subjected to further buckling forces.

It is apparent, therefore, that an improved method of shingling conveyed sheet material, particularly relatively lightweight paperboard, while avoiding the above-identified problems would be a desired improvement in the paperboard processing field.

BRIEF SUMMARY OF THE INVENTION

The invention provides an improved method and apparatus for shingling conveyed sheet material to solve the above-identified problems, mainly the tendency of lightweight paperboard to buckle transversely during high speed operations.

The vacuum shingler of the invention includes an outfeed conveyor which is positioned slightly downstream from a pair of rotary knives. The rotary knives act to cut a continuous roll of paperboard into individual sheets to be further processed. The outfeed conveyor is operated at a speed greater than the supply of paperboard, such that the outfeed conveyor creates a slight gap between successive individual sheets of material.

Upon exiting the outfeed conveyor, each individual sheet of material is transferred to a vacuum conveyor. Preferably, the vacuum conveyor is operated at a speed less than the outfeed conveyor, such that the individual sheets of material are shingled. The degree of shingling is dependent upon the relative speeds of the outfeed conveyor and the vacuum conveyor.

In accordance with the invention, a slowdown device, such as a smoothing roll or series of spring arms, is positioned above the vacuum conveyor, such that the leading edge of each individual sheet of material contacts the slowdown device upon exiting the outfeed conveyor. Preferably, the slowdown device is operated at a speed less than the speed of the outfeed conveyor, such that the slowdown devices slows the speed of the individual sheet of material before the sheet contacts the vacuum conveyor. In this manner, the slowdown device acts to reduce the stress placed on the individual sheet of material upon contacting the slower moving vacuum conveyor. In accordance with the invention, the slowdown device is movable in an upstream and a downstream direction, as well as in a direction toward and away from the vacuum conveyor.

In an additional feature of the invention, a controller is supplied which is in communication with the rotating knives and the vacuum conveyor. By monitoring the speed of the vacuum conveyor and the length of the individual sheets, the controller is able to vary the degree of shingling by adjusting the speed of the vacuum conveyor.

BRIEF DESCRIPTION OF THE SEVERAL VIEWS OF THE DRAWINGS

The single drawing FIGURE is a schematic in-line view of the device adapted to incorporate the various aspects of the invention.

DETAILED DESCRIPTION OF THE INVENTION

Figure 1:
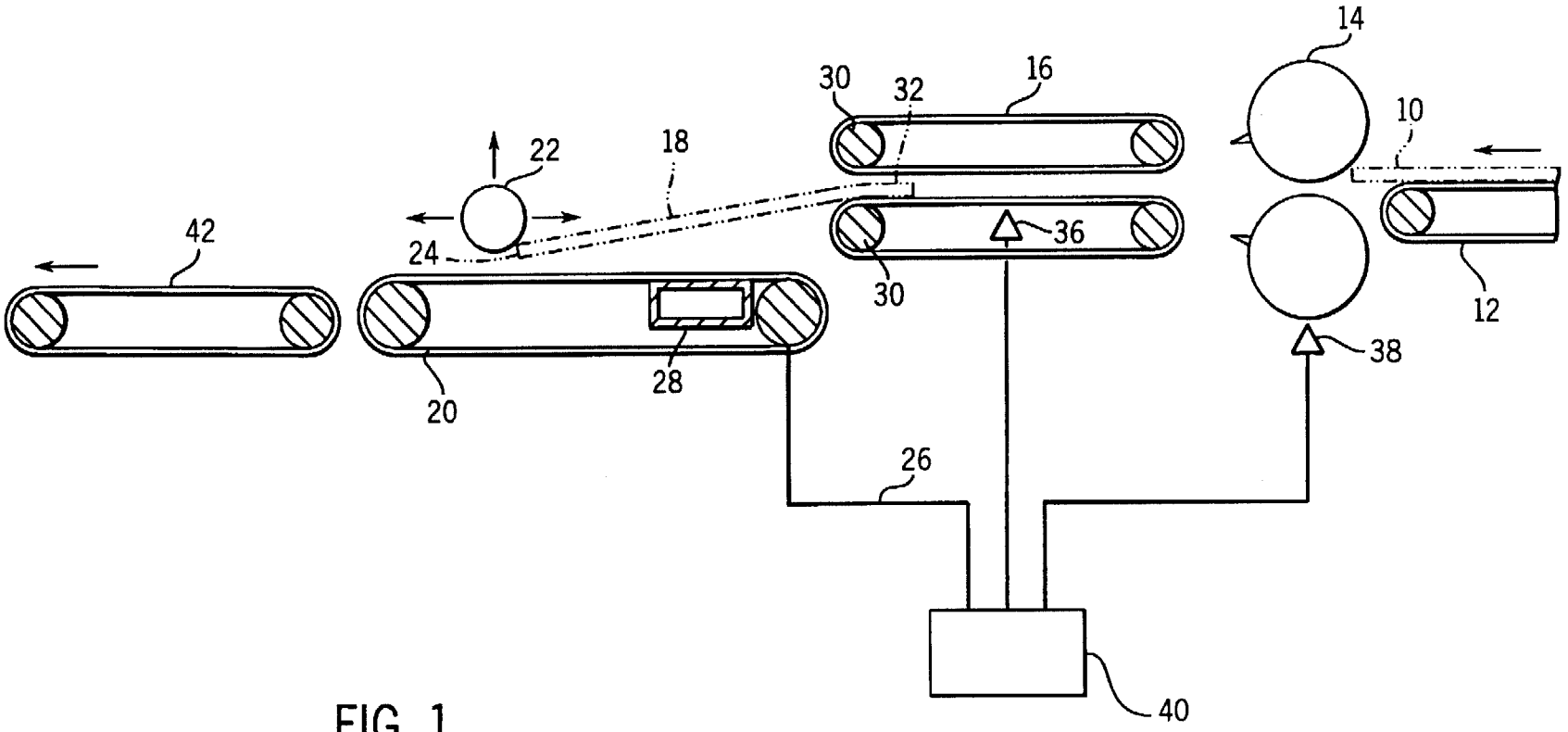

The invention relates to the shingling of delicate conveyed sheet material which is being conveyed at relatively high speeds. As shown in the drawing, a continuous web of paperboard 10 is fed by an inlet conveyor 12 from an upstream processing device (not shown). The paperboard web 10 is fed into the nip between a pair of rotating knives 14 which act to cut the continuous paperboard web 10 into individual sheets 20. A knife sensor 16 is positioned to monitor the position of and selectively operate the rotary knives 14. Sensor 16 is connected to a controller 18, the operation of which will be described in greater detail below.

After exiting the rotating knives 14, each individual sheet of material 20 is fed into an outfeed speed-up conveyor 22 which acts to pull the individual sheet 20 away from the rotating knives 14. The outfeed speed-up conveyor 22 consists of a pair of continuous belts 24 and 26 which are driven at identical speeds by a single motor (not shown). The belts 24 and 26 are each positioned around an upstream and a downstream roll 28 and 30.

The outfeed speed-up conveyor 22 is operated at a speed greater than the input conveyor 12, such that the speed-up conveyor 22 creates a gap between successive sheets 20.

After passing through the speed-up conveyor 22, each individual sheet 20 is transferred to a vacuum conveyor 32 consisting of an endless conveyor belt 34 connected between an upstream and a downstream roll 36 and 38. To create the desired shingling, the vacuum conveyor 32 is operated at a speed less than the outfeed speed-up conveyor 22. In this manner, successive sheets of material 20 overlap each other to create the desired shingling, as shown in the drawings. As can be understood from the drawing, the greater the difference between the speed of the vacuum conveyor 32 and the speed of the outfeed conveyor 22, the greater the degree of shingling. Shown in the drawing is an example where the vacuum conveyor 32 is operated at a speed nearly equal to the outfeed conveyor 22, such that the leading edge 40 of one sheet is located slightly forward of the trailing edge 42 of the preceding sheet.

As previously discussed, a problem associated with high speed handling of lightweight paperboard is the tendency of the paperboard to fold transversely or buckle across its width. To solve this problem, the device of the invention includes a slowdown device, such as, but not limited to, the smoothing wheel 44 shown in the drawing. While a smoothing roll 44 is shown in the drawing, it is understood that an alternate device, such as conventional spring fingers 144 could replace the smoothing roll 44 and allow the invention to operate as will be described below.

Before the individual sheets of paperboard 20 completely exit the outfeed conveyor section 22, the leading edge 40 of each sheet 20 contacts the smoothing roll 44. The smoothing roll 44 extends transversely with respect to the sheet travel path and has a length generally corresponding to the cross machine width of the individual sheets 20. The smoothing roll 44 nips the leading edge of the sheet 20 just before the trailing edge 44 exits the outfeed conveyor 22 thereby slowing the speed of the incoming sheet 20 to approximately the speed of the vacuum conveyor section 32. The smoothing roll 44 is operated to rotate at a speed between the speed of the outfeed conveyor section 22 and the slower speed of the vacuum conveyor section 32. In this manner, the smoothing roll 44 contacts the leading edge 40 and the entire sheet 20 is slowed to an intermediate speed before it contacts the slower vacuum conveyor 22. Once the speed of the individual sheet 20 is adequately slowed, the smoothing wheel 44 is lifted out of contact with the sheet 20.

As shown by the arrows in the drawing, the smoothing roll 44 is able to move both in an upstream and a downstream direction, as well as toward and away from the belt 34 of the vacuum conveyor section 32. The smoothing roll 44 must be movable upstream and downstream such that the position of the smoothing roll 44 can be adjusted based on the individual sheet length. It is important to position the smoothing roll 44 the correct distance from the outfeed conveyor 22 based on the individual sheet length such that the leading edge 40 contacts the smooth roll shortly before the trailing edge 42 exits the outfeed conveyor 22.

Also shown in the drawing is a vacuum box 46 positioned below the upper path of conveyor belt 34 of the vacuum conveyor section 32. As the individual sheet 20 completely exits the outfeed conveyor section 22, the vacuum box 46 acts only upon the tail section 48 of the sheet 20 to bring the tail 48 of the sheet 20 down into contact with the belt 34 of the vacuum conveyor 32. By positioning the vacuum box 46 only near the upstream roller 36, the leading edge 40 of each individual sheet 20 is able to slide across the conveyor belt 34 until the sheet 20 completely clears the outfeed conveyor 22. Once the sheet 20 has completely cleared the ouffeed conveyor 22, the vacuum box 46 acts to hold the individual sheet against the belt 34 to facilitate correct shingling.

Besides providing the smoothing roll 44, the system shown in the drawing also includes another innovation, specifically a control line 48 used to control the speed of the vacuum conveyor section 32. The control line 48 is operated by the controller 18 to vary the speed of the vacuum conveyor 32 based on the length of each individual sheet 20, such that a pre-selected percentage of sheet 20 overlaps the preceding sheet to provide proper shingling. In prior vacuum shinglers, the degree of shingling changed as the length of the individual sheets 20 increased. To adjust the degree of shingling, a manual speed adjustment had to be made to vacuum conveyor 32.

In the present invention, the controller 18 receives the sheet length information from sensor 16 which monitors the rotating knives 14. A second sensor 50 is also connected to the controller 18 and provides information concerning the position of each individual sheet 20. The controller 18 is able to process the information concerning the sheet length and speed of the outfeed conveyor 22 and vacuum conveyor 32 in order to calculate the degree of shingling. If the degree of shingling does not match a selected value, the controller 18 can increase or decrease the speed of vacuum conveyor 32 to provide the proper shingling.

Also shown in the drawing is a stack in-feed conveyor 52 which is used to move the shingled sheets 20 from the vacuum conveyor section 32 to a conventional sheet stacker.

It has been found that improved results can be obtained by combining the following modifications to the prior art method, specifically that taught in the '276 patent:

1. First, controlling the speed of the vacuum conveyor 32 based on the sheet length, such that a preselected percent of the individual sheet 20 overlaps the preceding sheet regardless of the individual sheet length.
2. Second, providing a slow-down device such as a smoothing wheel 44 or spring fingers positioned over the vacuum conveyor 32 to nip the leading edge 40 of the individual sheet 20. The slowdown device slows the incoming sheet 20 to approximately the speed of the vacuum conveyor 32 and is subsequently lifted out of contact with the sheet 20.

3. Third, applying a source of vacuum to the vacuum conveyor 32 only as the tail section 48 of the sheet 20 clears the downstream roll of the outfeed conveyor 22 to bring the tail section 48 down and into contact with the belt 34 of the vacuum conveyor 32.

Various modes of carrying out the invention are contemplated as being within the scope of the following claims particularly pointing out and distinctly claiming the subject matter which is regarded as the invention.

We claim:

1. A method of handling sheets conveyed in succession from a sheet source, the sheets being conveyed traveling at an initial speed along an input conveyor and having a leading edge a trailing edge, the steps comprising:

providing an outfeed conveyor positioned downstream of the input conveyor, the outfeed conveyor being operated at a speed greater than the initial speed;

providing a vacuum conveyor positioned downstream from the outfeed conveyor for receiving the sheets from the outfeed conveyor;

supplying a source of vacuum slightly downstream from an upstream end of the vacuum conveyor to pull the sheet into contact with the vacuum conveyor;

shingling the sheets by operating the vacuum conveyor at a speed less than the outfeed conveyor; and positioning a slowdown device above and out of contact with the vacuum conveyor, the slowdown device contacting the leading edge of each sheet exiting the outfeed conveyor prior to contact between the sheet and the vacuum conveyor, such that the slowdown device slows the speed of the sheet before the sheet is pulled into contact with the vacuum conveyor by the source of vacuum.

2. The method of claim 1 wherein the slowdown device is a series of spring fingers extending transversely across the sheet path.

3. The method of claim 1 wherein the slowdown device is a smoothing roll extending transversely to the sheet path.

4. The method of claim 3 further comprising the step of operating the smoothing roll at a speed less than the speed of the outfeed conveyor such that the smoothing roll slows the sheets.

5. The method of claim 1 further comprising the step of providing a controller in communication with the vacuum conveyor, the controller controlling the speed of the vacuum conveyor to control the degree of shingling.

6. The method of claim 5 further comprising the step of sensing the individual sheet length and generating a signal based on the sheet length to the controller such that the controller can adjust the speed of the vacuum conveyor based on the sheet length.

7. The method of claim 1 wherein the slowdown device is movable in an upstream and a downstream direction and in a direction toward and away from the vacuum conveyor.

8. The method of claim 1 further comprising the step of positioning the slowdown device a distance from the outfeed conveyor based on the sheet length such that the leading edge of the sheet contacts the slowdown device before the trailing edge exits the outfeed conveyor.

9. A device for handling sheets conveyed in succession from a sheet source in association with an input device for supplying sheets of a selected length at an initial speed, said sheets having a leading edge and a trailing edge, the device comprising:

an outfeed conveyor positioned downstream from the input device for receiving the sheets leaving the input conveyor, the outfeed conveyor being operated at a speed greater than the initial speed;

a vacuum conveyor having a downstream and an upstream end, the vacuum conveyor positioned downstream from the outfeed conveyor for receiving the sheets leaving the outfeed conveyor, the vacuum conveyor being operated at a speed less than the initial speed such that the sheets shingle on the vacuum conveyor;

a vacuum means positioned slightly downstream from the upstream end of the vacuum conveyor for pulling the sheet into contact with the vacuum conveyor; and a slowdown device positioned above the vacuum conveyor and less than the selected sheet length from the downstream end of said outfeed conveyor for contacting the leading edge of the sheet exiting the outfeed conveyor prior to contact between the sheet and the vacuum conveyor, such that the slowdown device slows the speed of the sheet before the sheet is pulled into contact with the vacuum conveyor by the vacuum means.

10. The device of claim 9 wherein the slowdown device is a series of spring fingers extending transversely across the sheet flow path.

11. The device of claim 9 wherein the slowdown device is a smoothing roll extending transversely across the sheet flow path, the smoothing roll being rotated at a speed less than the speed of the outfeed conveyor.

12. The device of claim 9 wherein the slowdown device is movable in an upstream and a downstream direction and in a direction toward and away from the vacuum conveyor.

13. The device of claim 9 further comprising a controller in operating communication with the vacuum conveyor to control the operating speed of the vacuum conveyor.

14. The device of claim 13 further comprising a sensor positioned to measure the length of the conveyed sheets, the sensor generating a signal to the controller such that the controller can vary the speed of the vacuum conveyor based on the length of the conveyed sheets.

* * * * *